United States Patent [19]

Morimitsu

[11] 3,938,917

[45] Feb. 17, 1976

[54] LINEAR OIL SEAL MEANS PRINCIPALLY INTENDED TO OBTAIN AN OIL SCRAPING EFFECT

[75] Inventor: Nobutaka Morimitsu, Toyota, Japan

[73] Assignee: Toyota Jidosha Kogyo Kabushiki Kaisha, Japan

[22] Filed: Dec. 10, 1973

[21] Appl. No.: 423,146

[30] Foreign Application Priority Data

July 17, 1973 Japan ..... 48-79810

[52] U.S. Cl. ..... 418/142

[51] Int. Cl.[2] ..... F01C 19/08; F04C 27/00

[58] Field of Search ..... 418/142; 277/24, 96 A; 184/11 A; 308/36.1, 36.5; 123/8.01

[56] References Cited

UNITED STATES PATENTS

| | | | |
|---|---|---|---|
| 1,270,776 | 7/1918 | Boomershine | 308/36.1 |
| 3,323,713 | 6/1967 | Wenderoth et al. | 418/142 |
| 3,575,541 | 4/1971 | Hamada | 418/142 |

FOREIGN PATENTS OR APPLICATIONS

| | | | |
|---|---|---|---|
| 1,189,786 | 3/1965 | Germany | 123/8.01 |
| 1,300,123 | 7/1969 | Germany | 418/142 |

*Primary Examiner*—John J. Vrablik

*Attorney, Agent, or Firm*—Stewart and Kolasch, Ltd.

[57] ABSTRACT

A linear oil seal means principally intended to obtain an oil scraping effect in a rotary piston engine, comprising a linear oil seal element mounted in a linear groove formed as cut at the side wall portion of the rotor along a line extending from an outer peripheral portion of the conventional annular oil seal means provided at the side wall of the rotor to a vicinity of the conventional corner seal of the rotor and adapted to exert a radially inwardly oriented force component to the oil to be scraped during the rotation of the rotor.

5 Claims, 2 Drawing Figures

LINEAR OIL SEAL MEANS PRINCIPALLY INTENDED TO OBTAIN AN OIL SCRAPING EFFECT

BACKGROUND OF THE INVENTION

1. Field of the Invention

This invention relates to an oil seal means of a rotary piston engine, and more particularly, a linear oil seal means principally intended to obtain an oil scraping effect.

2. Description of the Prior Art

A rotary piston engine has generally a center housing having a trochoidal inside surface and at least two side housings closing opposite open ends of said center housing to define a chamber therein, in which is eccentrically rotated a polygonal rotor, wherein the oil and gas tightness between said rotor and said side housing is maintained by an oil seal means composed of an oil seal ring mounted in an annular oil seal groove formed as a cut in a side wall portion of the rotor and urged against the inner wall of the side housing under the action of a spring force. An annular elastic means such as an O-ring is adapted to intercept the fluid passage crossing an annular space left between the wall of said annular oil seal groove and said oil seal ring.

In the oil seal means of the abovementioned structure, the axial outer end face of the oil seal ring is so shaped that it contacts with the inside surface of the side housing along the radially inside peripheral portion thereof and extends therefrom as inclined towards the radially outside portion thereof thereby defining a wedge space opening towards the radially outside region of the rotor between the inside surface of the side housing and the rotor, whereby it is so adapted that the oil flowing radially inwardly of the rotor by being urged by the gas pressure in the operating chamber is caught by the wedge membrane effect and recovered and that the oil flowing radially outwardly under pressure from the side of the eccentric shaft is scraped to prevent leakage of oil into the operating chamber. However, the oil recovering function made by the conventional oil seal means is only accomplished in a region located within an envelope of loci drawn by said annular oil seal ring during the rotation of the rotor. Therefore, by employing the conventional oil seal means, it is difficult to recover the oil which has moved out of said envelope, oil usually flows up to a corner seal and then enters into the combustion chamber through a clearance of the corner seal as well as that apex seal which burned therein, whereby there occurs much loss of oil and movability of the sealing means is affected by oil sludge.

SUMMARY OF THE INVENTION

Therefore, it is the object of this invention to solve the abovementioned problem and to provide an oil seal means principally intended to obtain an oil scraping effect that easily enables recovery of the oil which has been previously lost from said envelope of the loci of the oil seal ring.

The abovementioned object is accomplished, according to this invention, by providing a linear oil seal means for a rotary piston engine, said engine including an oil seal ring mounted in an annular oil seal groove formed as cut in a side wall portion of a rotor and urged onto the inner wall of the side housing of said engine under the action of a spring force. An annular elastic means is provided to intercept the fluid passage crossing an annular space left between the wall of said annular oil seal groove and said oil seal ring. The linear oil seal element is mounted in a linear groove formed as a cut in the side wall portion of the rotor along a line extending from an annular peripheral portion of said annular oil seal groove to the vicinity of the corer seal of the rotor, said element being urged against the inner wall of the side housing under the action of a spring force.

The linear oil seal means slides over the whole area of the inner surface of the side housing located outside the envelope of the loci drawn by the conventional oil seal ring during the rotation of the rotor about the eccentric shaft. Therefore, when said line is so inclined to the rotating direction of the rotor that the said linear oil seal element exerts a radially inwardly oriented force component to the oil to be scraped by said linear element, the oil which has flown out of said envelope is caught by the linear oil seal means and gradually returned to the region located within said envelope.

According to a particular feature of this invention, said line may be so determined that the radially outer end of said linear seal element joins a side seal element extended between two adjacent corner seals along the outer periphery of the rotor at a position preceding said corner seal as seen in the rotating direction of the rotor, said position being located outside said envelope.

Said linear oil seal element may be a linear member having a substantially rectangular cross section. Such a linear member may preferably be mounted in the groove formed as a cut in the side wall portion of the rotor and correspondingly shaped to allow sliding movement of said linear member therein so that the linear member is received in said groove so as to be freely slidable in the axial directions of the rotor according to the rotation of the rotor.

Said linear member should preferably be elastically supported against the bottom wall of said groove by way of a spring means, such as a corrugated spring.

In order to obtain a good oil scraping effect by the linear oil seal means according to this invention, it is of course preferable that said linear oil seal means is provided in plurality in a number corresponding to the number of the apexes of the rotor for each one side of the rotor. In this case, said plurality of linear oil seal means should preferably be arranged symmetrically about the axis of the rotor.

BRIEF DESCRIPTION OF THE DRAWING

In the accompanying drawing.

DESCRIPTION OF THE PREFERRED EMBODIMENT

Figure 1:
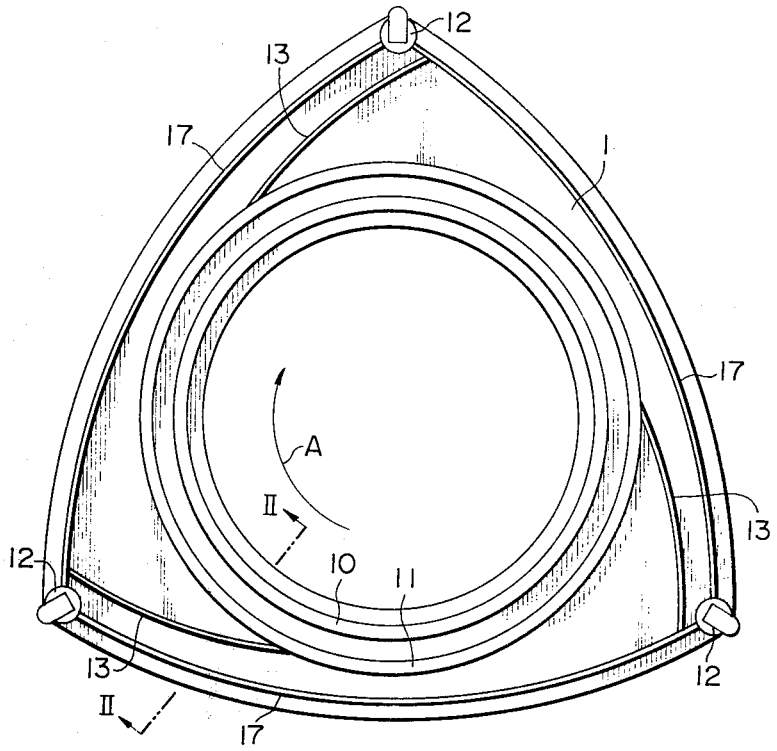
FIG. 1 is a side view of a rotor provided with the linear oil seal means according to this invention; and, FIG. 2 is a section along line II—II in FIG. 1 but on an enlarged scale.
Figure 2:
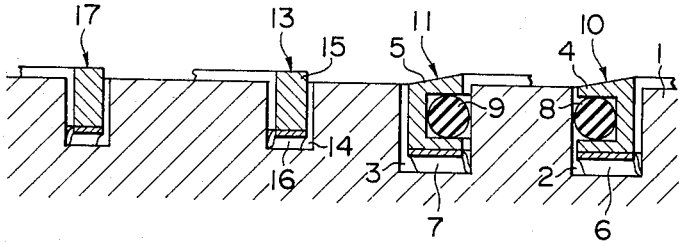

In the following, this invention will be described in more detail of a preferred embodiment with reference to the accompanying drawing.

In the drawing, a rotor 1 is provided with annular side seal means 10 and 11 composed of annular oil seal grooves 2 and 3 formed as cut at side wall portions of the rotor, oil seal rings 4 and 5 mounted in said annular oil seal grooves, corrugated annular springs 6 and 7 mounted between the bottom faces of said oil seal rings and the bottom wall portions of said annular oil seal grooves in a manner to exert spring forces to urge said oil seal rings out of said grooves, and O-rings 8 and 9 made of an elastic material such as rubber each of said O-rings being adapted to intercept a fluid passage crossing an annular space left between the wall portions of said annular oil seal groove and said oil seal ring, respectively. Along a line extending from an outer peripheral portion of the outside side seal 11 up to the vicinity of a corner seal 12 located at the apex portion of the rotor, there is provided a linear oil seal means 13 according to the present invention. The linear oil seal means 13 comprises a linear groove 14 formed as cut at a side wall portion of the rotor and a linear sealing element 15 mounted in said groove, said linear sealing element having exerted thereon a spring force by a corrugated spring 16 positioned between the bottom face of said sealing element and the bottom wall of said linear groove so as to be resiliently urged outwardly from said groove 14, whereby the front end portion of the linear sealing element is pushed onto the inner surface of the side housing.

The rotor 1 is rotatable in the direction of arrow A, and as related therewith, the linear oil seal means 13 is arranged to follow a line extending as inclined, as shown in FIG. 1. In operation, when the rotor is rotated in the direction of arrow A, the oil residing in the area located outside the envelope of the loci drawn by the oil seal ring 5 is scraped by the linear oil seal means 13 toward the center of the rotor and is gradually brought into the area located within said envelope. Thereafter, the oil is caught by the oil seal rings 5 and 4 of the scraper type and is recovered into the inside of the rotor.

In the drawing, 17 is a outermost side seal means having substantially the same cross sectional constitution as the linear oil seal means 13.

I claim:

1. In a rotary piston engine including a polygonal rotor containing side walls and having a plurality of apex portions with a corner seal being provided at each apex portion, at least one annular oil seal means and side seal means, said annular oil seal means comprising an annular oil seal groove disposed in the side wall portion of the rotor, said oil seal groove containing an annular oil seal ring resiliently supported by a spring means, said annular oil seal ring housing an annular elastic means which intercepts an annular space left between said annular oil seal ring and said annular oil seal groove, said side seal means comprising a linear groove disposed in the side wall portion of said rotor and extending between two adjacent corner seals provided at respective apex portions of said linear groove containing a linear sealing element resiliently supported by a spring means, the improvement which comprises providing a linear oil seal means which extends between said annular oil seal means and said side seal means, said linear oil seal means comprising a linear groove disposed in the side wall portion of said rotor, said linear groove containing a linear sealing element resiliently supported by a spring means, said linear oil means joining said side seal means in a region located on one side of a line which connects a particular corner seal with the central axis of the rotor, said linear oil seal means joining the annular oil seal means in a region located on the other side of said line said one side preceding the corner seal, as seen in the direction of rotation of the rotor.

2. The rotary piston engine of claim 1, wherein the linear oil seal element is a linear member having a substantially rectangular cross section.

3. The rotary piston engine of claim 1, wherein the spring means is a corrugated spring.

4. The rotary piston engine of claim 1, wherein the linear oil seal means is provided in plurality in a number corresponding to the number of apexes of the rotor for each one side of the rotor.

5. The rotary piston engine of claim 4, wherein said plurality of linear oil seals are arranged symmetrically about the axis of the rotor.

* * * * *